US011050131B2

(12) United States Patent
Wu et al.

(10) Patent No.: US 11,050,131 B2
(45) Date of Patent: Jun. 29, 2021

(54) ANTENNA MOUNTING BASE AND ANTENNA

(71) Applicant: HARXON CORPORATION, Guangdong (CN)

(72) Inventors: Wenping Wu, Guangdong (CN); Shiwei Wu, Guangdong (CN); Jie Zhang, Guangdong (CN)

(73) Assignee: HARXON CORPORATION, Guangdong (CN)

( * ) Notice: Subject to any disclaimer, the term of this patent is extended or adjusted under 35 U.S.C. 154(b) by 0 days.

(21) Appl. No.: 16/622,047

(22) PCT Filed: Jul. 20, 2018

(86) PCT No.: PCT/CN2018/096490
§ 371 (c)(1),
(2) Date: Dec. 12, 2019

(87) PCT Pub. No.: WO2019/119798
PCT Pub. Date: Jun. 27, 2019

(65) Prior Publication Data

US 2020/0185810 A1 Jun. 11, 2020

(30) Foreign Application Priority Data

Dec. 20, 2017 (CN) ..... 201711386649.1

(51) Int. Cl.
*H01Q 1/12* (2006.01)
*H01Q 15/14* (2006.01)

(52) U.S. Cl.
CPC ..... *H01Q 1/12* (2013.01); *H01Q 15/14* (2013.01)

(58) Field of Classification Search
CPC ..... H01Q 1/12; H01Q 1/50; H01Q 15/14; H01Q 19/108; H01Q 21/26
(Continued)

(56) References Cited

U.S. PATENT DOCUMENTS 6,522,302 B1 * 2/2003 Iwasaki ..... H01Q 9/16 343/725

FOREIGN PATENT DOCUMENTS

| | | | |
|---|---|---|---|
| CN | 104966887 | A | 10/2015 |
| CN | 107046167 | A | 8/2017 |
| CN | 108123206 | A | 6/2018 |

OTHER PUBLICATIONS

International Search Report dated Sep. 26, 2018 for corresponding International Application No. PCT/CN2018/096490, filed Jul. 20, 2018.

(Continued)

*Primary Examiner* — Lam T Mai
(74) *Attorney, Agent, or Firm* — David D. Brush; Westman, Champlin & Koehler, P.A.

(57) ABSTRACT

Disclosed is an antenna mounting base and an antenna, the antenna mounting base comprising: an antenna substrate, a fixing plate and an annular reflective plate, wherein the antenna substrate is of a bowl-shaped structure, and an edge of an opening of the bowl-shaped structure is fixed to the fixing plate; the annular reflective plate stands on the fixing plate and is fixed to the fixing plate; the annular reflective plate and the antenna substrate are located on the same side of the fixing plate; and a feed support base is provided inside the bowl-shaped structure. In comparison with existing product technology, this antenna is simple to assemble, and has stronger structural consistency, and furthermore, the low pitch angle gain of the antenna is higher.

20 Claims, 5 Drawing Sheets

(58) Field of Classification Search
USPC ..... 343/725, 834
See application file for complete search history.

(56) References Cited

OTHER PUBLICATIONS

Written Opinion of the International Searching Authority dated Sep. 26, 2018 for corresponding International Application No. PCT/CN2018/096490, filed Jul. 20, 2018.
Chinese Office Action dated Mar. 29, 2019 for corresponding Chinese Application No. 201711386649.1.
English translation of the Chinese Office Action dated Mar. 29, 2019 for corresponding Chinese Application No. 201711386649.1.

* cited by examiner

ANTENNA MOUNTING BASE AND ANTENNA

CROSS-REFERENCE TO RELATED APPLICATION

The present application is a national phase entry under 35 USC § 371 of International Application PCT/CN2018/096490, filed Jul. 20, 2018, and published as WO 2019/119798 A1, on Jun. 27, 2019, not in English, which claims the benefit of and priority to Chinese Patent Application No. 201711386649.1, filed on Dec. 20, 2017, the entire disclosures of which are incorporated herein by reference.

FIELD

The present disclosure relates to a technology field of antennas, particularly to an antenna mounting base and an antenna.

BACKGROUND

The existing multi-frequency circular polarization GNSS (Global Navigation Satellite System) antennas are commonly in the form of laminated microstrip antennas, metal half-wave dipole antennas, helical antennas, and etc. Technically, both the laminated microstrip antennas and the metal half-wave dipole antennas realize a certain function in terms of a bandwidth, but there are still many problems.

For the laminated microstrip antenna, the bandwidth advantage is not obvious, a beam width of the antenna is not wide, gain at a low elevation angle is poor, and requirement for consistency makes structure assembly more difficult and cost higher. The metal half-wave dipole can realize a broadband form, but the beam width is not wide, the gain at the low elevation angle is poor, the structure assembly is complicated, and the cost is high. Multi-frequency helical antenna has a wide beam width but low gain.

In the use of GNSS antenna, the above problems of poor gain at the low elevation angle directly lead to a problem of relatively poor anti-multipath effect, that is, the ranging error of antenna increases, resulting in poor positional accuracy.

SUMMARY

(I) Technical Problems to be Solved

In order to solve the above technical problems or at least partially solve the above technical problems, the present disclosure provides an antenna mounting base and an antenna.

(II) Technical Solutions

In view of this, in a first aspect, the present disclosure provides an antenna mounting base including an antenna substrate, a fixing plate and an annular reflective plate, wherein, the antenna substrate is of a bowl-shaped structure, and an edge of an opening of the bowl-shaped structure is fixed to the fixing plate; the annular reflective plate stands on the fixing plate and is fixed to the fixing plate; the annular reflective plate and the antenna substrate are located at the same side of the fixing plate;

a feed support base is provided inside the bowl-shaped structure. Alternatively, the antenna substrate includes a mounting flat plate and four mounting inclined plates, wherein, four mounting inclined plates are uniformly distributed around the mounting flat plate;

a first side edge of the mounting inclined plate is fixed to an edge of the mounting flat plate; a second side edge of the mounting inclined plate is fixed to the fixing plate, the first side edge and the second side edge being opposite in position;

an included angle is formed between the mounting inclined plate and the mounting flat plate.

Alternatively, four threading through holes are uniformly arranged in the mounting flat plate, and the feed support base includes four cable mounting channels, the position of each cable mounting channel corresponding to the position of one threading through hole.

Alternatively, four open slots are arranged on the annular reflective plate;

the four open slots divide the circumference of the annular reflective plate equally, and the center of each open slot corresponds to the center between the two mounting inclined plates.

Alternatively, the fixing plate is annular;

the edge at the opening of the bowl-shaped structure is fixed to an inner edge of the annular fixing plate;

the annular reflective plate is fixed to an outer edge of the annular fixing plate, the annular reflective plate being perpendicular to the fixing plate.

Alternatively, further including a bottom plate, wherein, the bottom plate is fixed to the fixing plate, and the bottom plate and the antenna substrate are respectively located on different sides of the fixing plate;

a mounting through hole is arrange on the bottom plate, the position of the mounting through hole corresponding to the position of the feed support base.

In a second aspect, the present disclosure provides an antenna including an antenna mounting base according to the first aspect, further including a tuning director, a feed network, a reflector plate and a radiating sheet, wherein, four fixing columns are arranged on the outer surface of the mounting flat plate of the antenna mounting base, and the four fixing columns are uniformly distributed on the mounting flat plate;

the tuning director is connected to an outer surface of the bottom of the bowl-shaped structure of the antenna substrate through a plurality of fixing columns, and an interval is arrange between the tuning director and the antenna substrate; the radiating sheet is fixed on the outer surface of the bowl-shaped structure of the antenna substrate;

the reflector plate is fixed on the annular reflective plate and is provided with at least one open slot;

the feed network is mounted in the feed support base, and the feed network is electrically connected to the radiating sheet.

Alternatively, there are four radiating sheets in the antenna, wherein, each radiating sheet includes a first sub-part and a second sub-part, wherein the first sub-parts of the four radiating sheets are all located on the mounting flat plate and are provided with intervals with each other, the first sub-parts of the four radiating sheets being equal in area and being all triangular;

the first sub-part of each radiating sheet is provided with a wiring through hole and a fixing column through hole for passing through the fixing column;

the areas of the second sub-parts of the four radiating sheets are equal and are respectively located on different mounting inclined plates, the second sub-parts are composed of rectangles and triangles, the first side edge of the rectangle is connected to the long side of the triangle in the first sub-part, and the other side edge of the rectangle opposite to the first side edge is connected to the long side of the triangle of the second sub-part.

Alternatively, four open slots are arranged on the reflector plate, and the positions of the four open slots respectively correspond to the interval between the four radiating sheets, such that the reflector plates between adjacent open slots respectively correspond to one reflector plate.

Alternatively, the feed network includes two pairs of coaxial cables and a 90° phase shifter, wherein, two pairs of coaxial cables are staggered in the feed support base; the 90° phase shifter and two pairs of coaxial cable are respectively located on different sides of the bottom plate;

each pair of coaxial cables includes a first coaxial cable and a second coaxial cable, wherein the outer conductors of the first coaxial cable and the second coaxial cable are respectively connected to one radiating sheet through the wiring through hole, and the radiating sheets connected to the two pairs of coaxial cables are staggered; the end of the inner conductor of the first coaxial cable is in a broken circuit; the inner conductor of the second coaxial cable is electrically connected to the 90° phase shifter.

Alternatively, the tuning director is a metal plate, and the shape of the tuning director is circular;

and/or;

the radiating sheet is a printed metal layer arranged on the outer surface of the antenna substrate;

and/or, the reflector plate is a printed metal layer arranged on the outer surface of the annular reflective plate, and the shape of the reflector plate is consistent with the shape of the annular reflective plate.

(III) Beneficial Effects

In comparison with existing product technology, the above technical solutions provided by the embodiments of the present disclosure have the following advantages:

In comparison with existing product technology, the antenna provided by the embodiments of the present disclosure is simple to assemble, and has stronger structural consistency. The radiating sheet can be directly printed on the outer surface of the antenna substrate, and the feed coaxial cable can be directly attached to the antenna substrate when the radiating sheet and the feed coaxial cable are mounted. In addition, the antenna substrate, the fixing plate and the annular reflective plate in the antenna mounting base can be integrally formed, in such a manner that the supporting thickness of the substrate on the back surface of the radiating sheet is thin when used as an antenna, thereby reducing the dielectric loss of the antenna and improving the low gain at a low elevation angle of the antenna.

According to the antenna provided by the embodiments of the disclosure, in actual application, the beam width is adjustable, and the product body has strong adaptability; the reflector plate on the annular reflective plate is mainly used for adjusting the beam width and the return loss; in actual application, the current distribution mode can be changed by adjusting the height on the annular reflective plate, i.e. adjusting the width of the reflector plate, such that the adjustment of the beam width and the return loss can be realized, in such a manner that the required beam width and the smaller return loss can be obtained under different use conditions, and further the required low gain at a low elevation angle and beam width can be obtained.

In addition, since the feed network adopts a broadband compensation branch conductor balun feed network, the first coaxial cable 70 and the second coaxial cable 71 of the feed network are a group, and the first coaxial cable 70 and the second coaxial cable 71 are connected as inner conductors, and the outer conductors are respectively connected to the aligned radiating sheet 9, that is, connected to the radiating sheet. The second coaxial cable 71 is a direct feed connection line, with an input impedance of 50Ω, the first coaxial cable 70 is in a broken circuit at the end of the inner conductor, with an impedance of 35Ω, and the length of the first coaxial cable 70 can be adjusted according to the designed frequency band adjustment, so that the current balance of the antenna is good, and the impedance matching bandwidth is adjustable.

DETAILED DESCRIPTION

In order to make the purpose, technical solution and advantages of the embodiments of the present disclosure clearer, reference will be made clearly and completely technical solutions in the embodiments of the present disclosure with accompanying drawings. Obviously, the embodiments described here are only part of the embodiments of the present disclosure and are not all embodiments of the present disclosure. Based on the embodiments of the present disclosure, other embodiments obtained by those skilled in the art without creative labor are within scope of the present disclosure.

Figure 1:
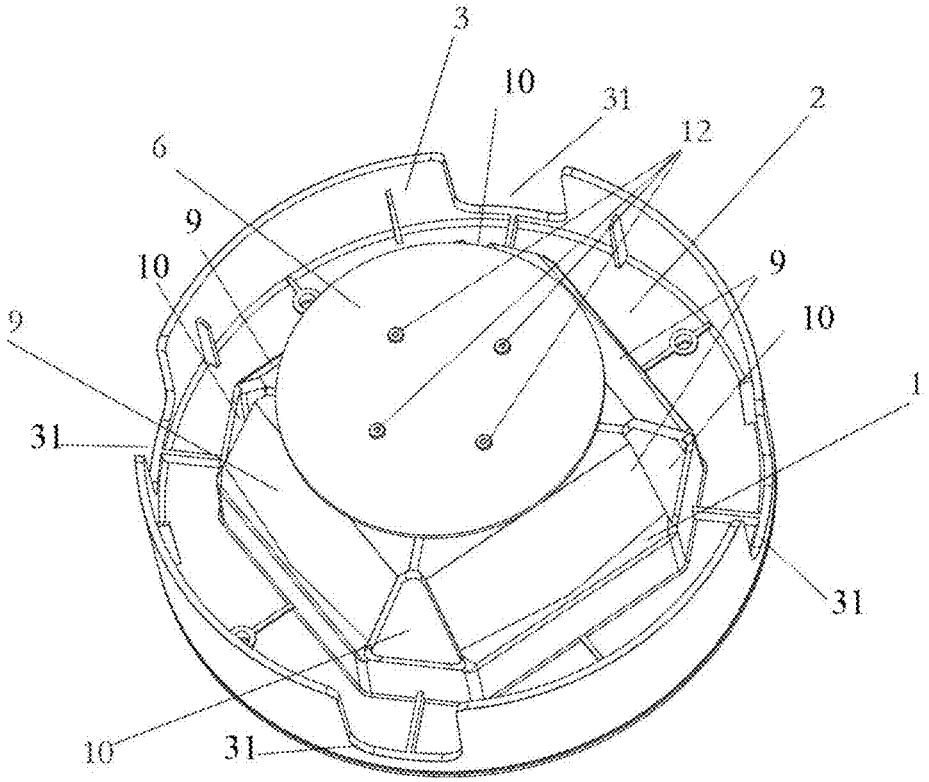
FIG. 1 is a schematic view illustrating an antenna according to embodiments of the present disclosure.
Figure 2:
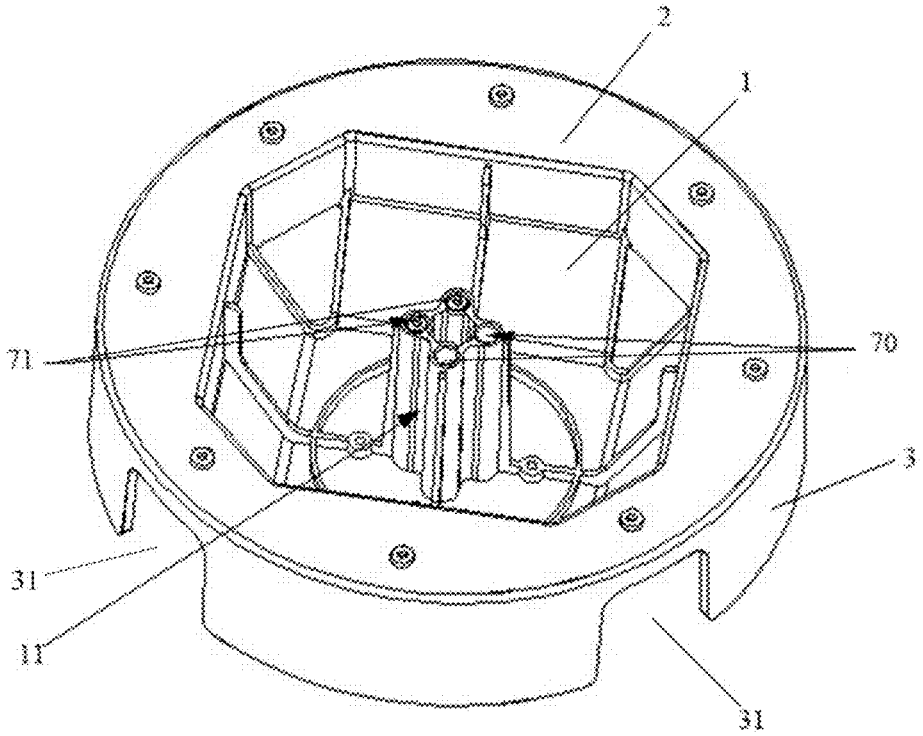
FIG. 2 is a schematic view illustrating a back surface according to FIG. 1.
Figure 3:
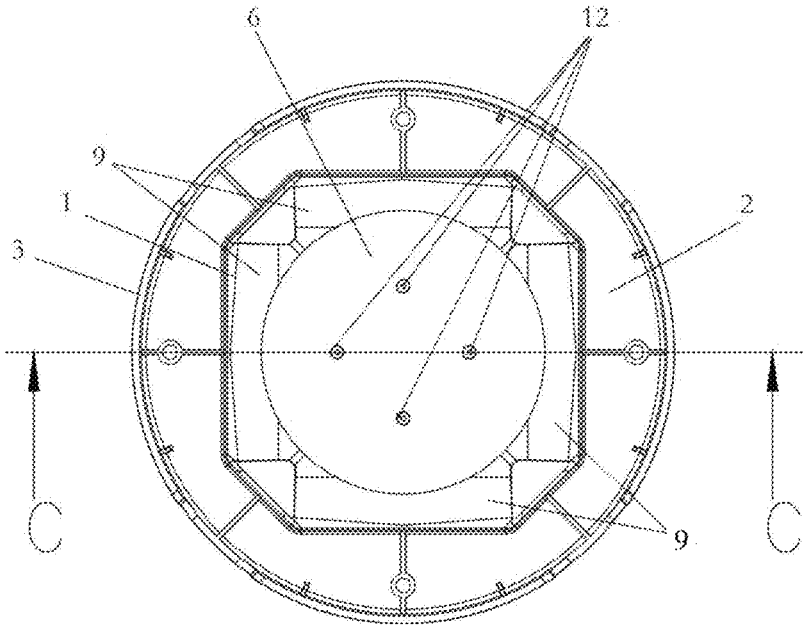
FIG. 3 is a top view according to FIG. 1.
Figure 4:
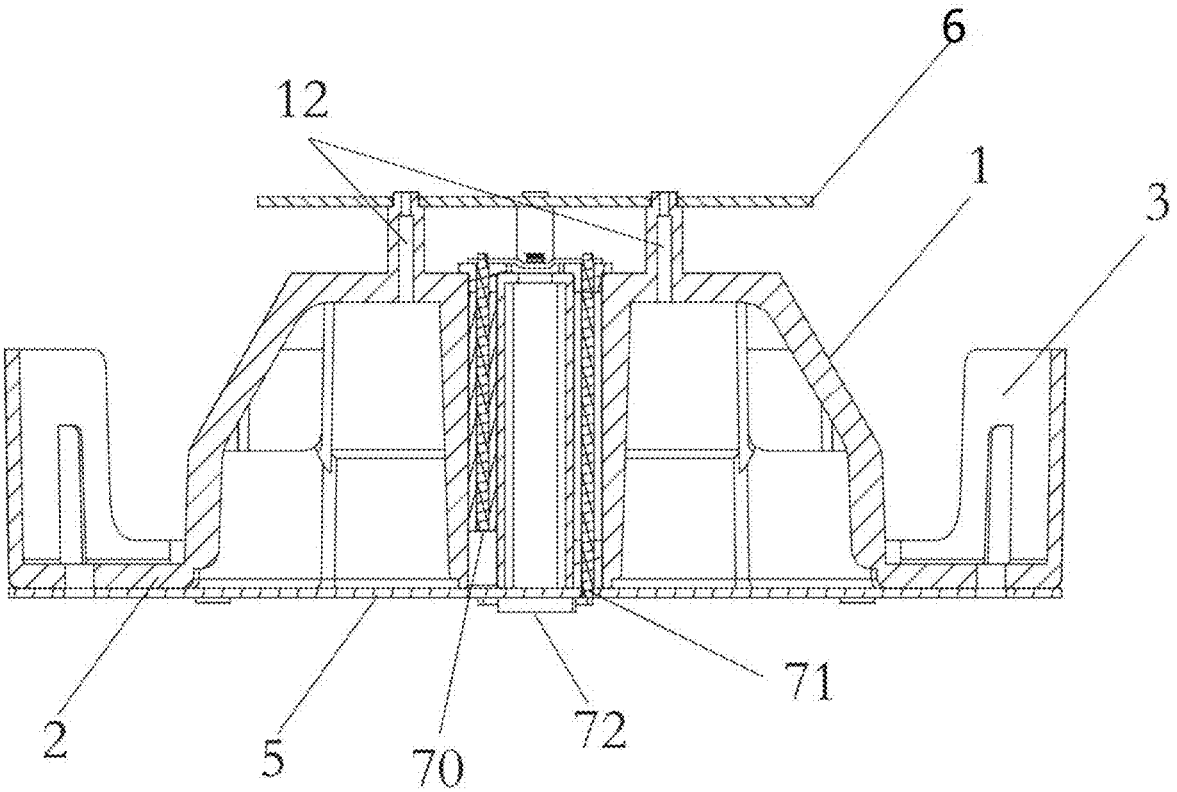
FIG. 4 is a schematic sectional view illustrating a plane C-C according to FIG. 3.
Figure 5:
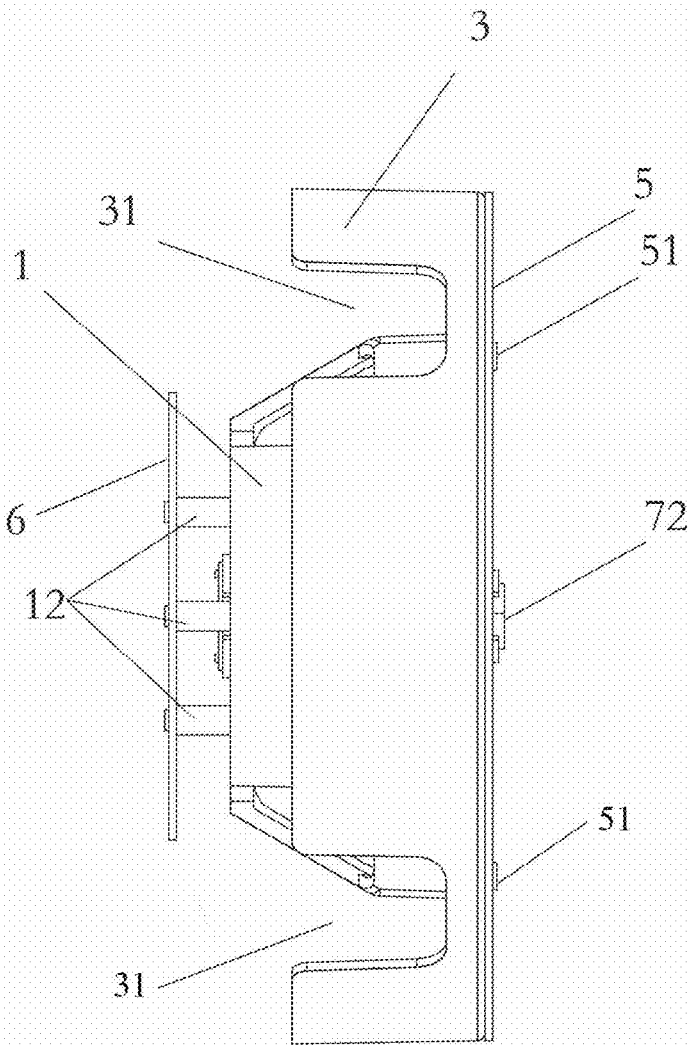
FIG. 5 is a right view according to FIG. 1.
Figure 6:
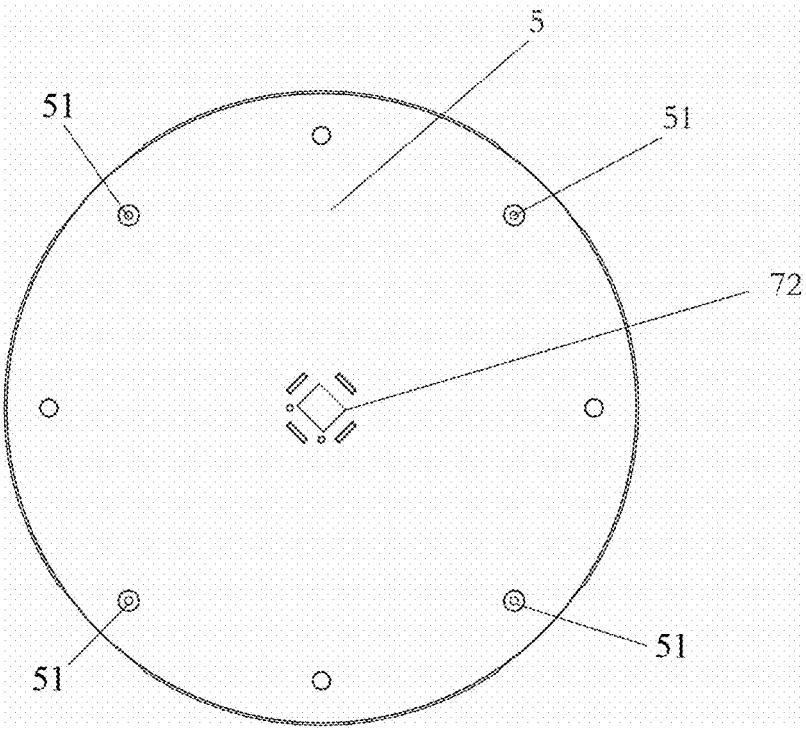
FIG. 6 is a rear view according to FIG. 3.

FIG. 1 is a schematic view illustrating an antenna according to embodiments of the present disclosure. FIG. 2 is a schematic view illustrating a back surface according to FIG. 1. FIG. 3 is a top view according to FIG. 1. FIG. 4 is a schematic sectional view illustrating a plane C-C according to FIG. 3. FIG. 5 is a right view according to FIG. 1. FIG. 6 is a rear view according to FIG. 3.

Figure 7:
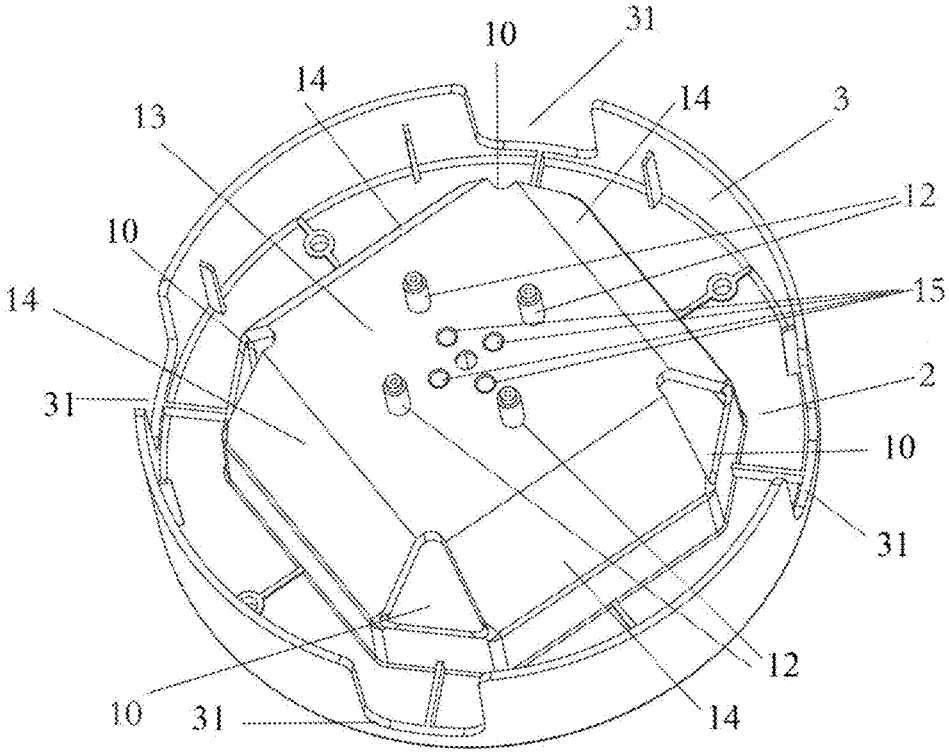
FIG. 7 is a schematic view illustrating an antenna mounting base according to embodiments of the present disclosure.
Figure 8:
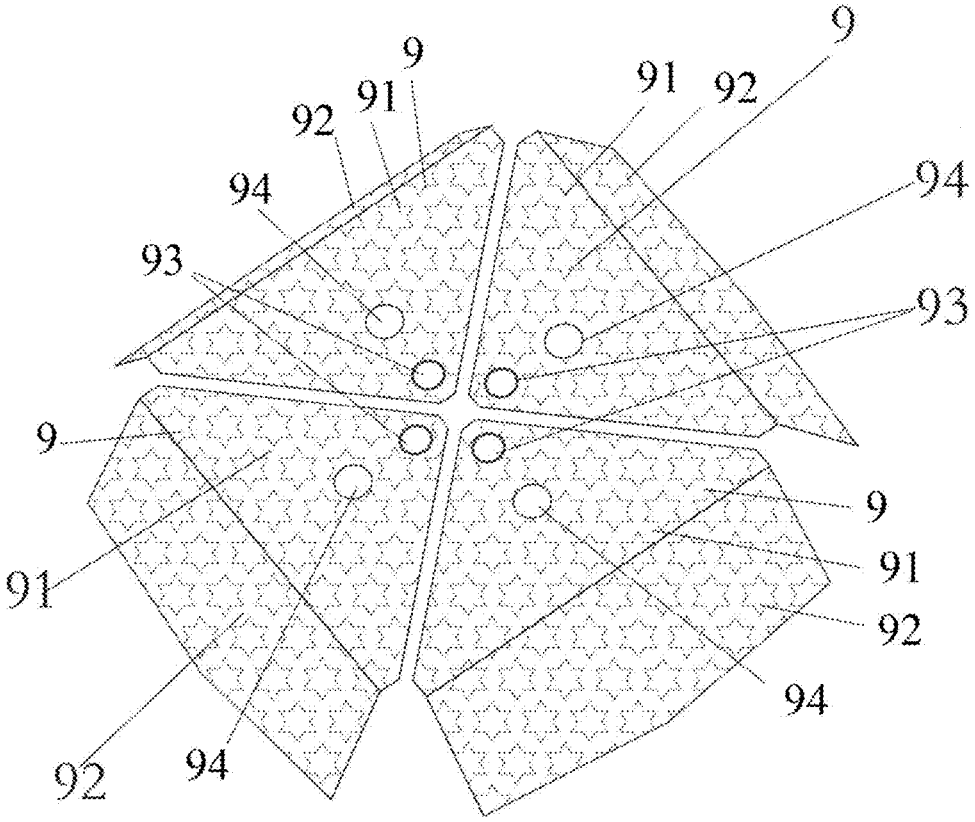
FIG. 8 is a schematic view illustrating a radiating sheet.
Figure 9:
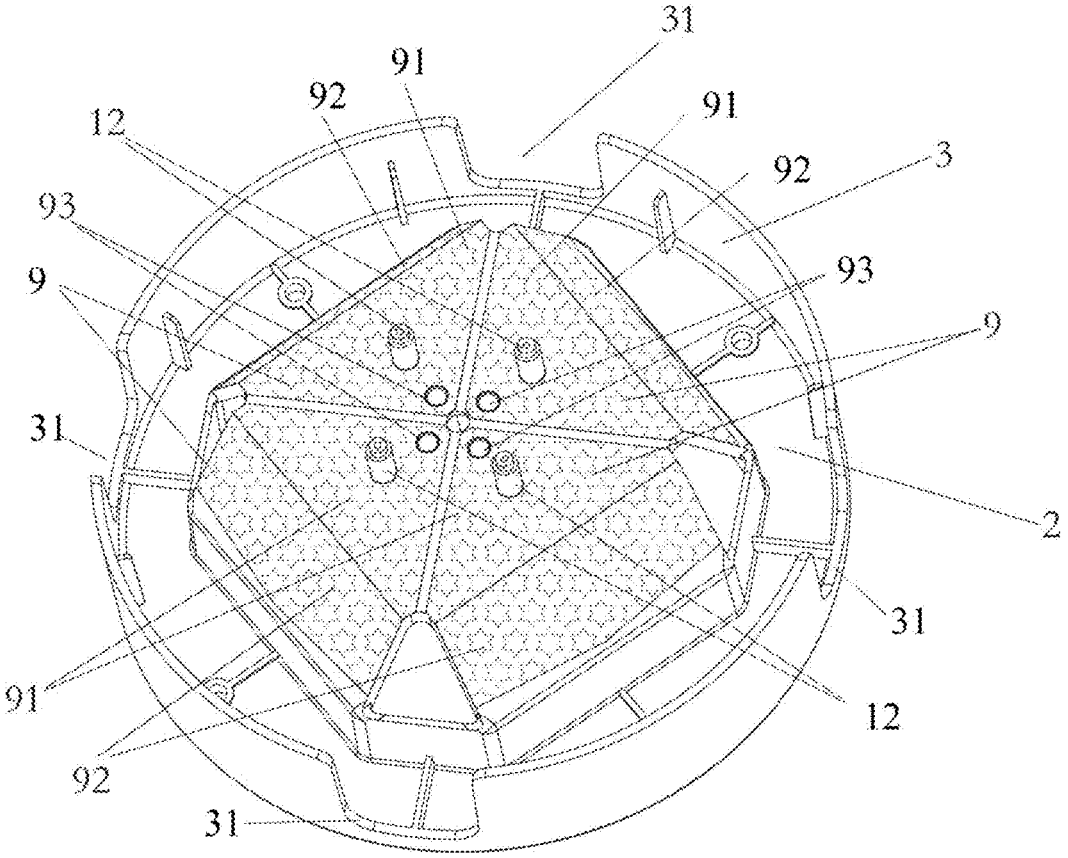
FIG. 9 is schematic view illustrating the antenna mounting base when the radiating sheet is mounted.

FIG. 7 is a schematic view illustrating an antenna mounting base according to embodiments of the present disclosure. FIG. 8 is a schematic view illustrating a radiating sheet. FIG. 9 is schematic view illustrating the antenna mounting base when the radiating sheet is mounted.

The antenna provided by the embodiments of the present disclosure includes an antenna mounting base and an electrical part.

In a first aspect, as illustrated in FIGS. 1-9, the embodiments of the present disclosure provide an antenna mounting base, and the antenna mounting base includes an antenna substrate 1, a fixing plate 2 and an annular reflective plate 3.

The antenna substrate 1 is of a bowl-shaped structure, specifically a groove, such as a circular groove or a square groove, and etc. The antenna substrate 1 as a main carrier of the antenna is used for a radiating sheet to be mounted, and normally, the radiating sheet is mounted on an outer surface of the bowl-shaped structure of the antenna substrate 1.

As illustrated in FIG. 4, the antenna substrate 1 includes a mounting flat plate 13 and four mounting inclined plates 14, the four mounting inclined plates 14 are uniformly distributed around the mounting flat plate 13; and a hollow hole 10 is arranged between any two mounting inclined plates 14.

A first side edge of the mounting inclined plate 14 is fixed to an edge of the mounting flat plate 13; a second side edge of the mounting inclined plate 14 is fixed to the fixing plate 2, the first side edge and the second side edge are opposite, and an included angle is defined between the mounting inclined plate 14 and the mounting flat plate 13. A structure including five plates of one mounting flat plate 13 and four mounting inclined plates 14 is formed.

As illustrated in FIG. 7, generally, an antenna radiating surface is located on an outer surface of the mounting flat plate 13 of the antenna substrate 1. In order to facilitate electrical connection between the assembled antenna radiating surface and an inside of the antenna substrate 1, four threading through holes 15 are uniformly arranged in the mounting flat plate.

As illustrated in FIGS. 1, 6 and 7, an edge at an opening of the bowl-shaped structure is fixed to the fixing plate 2, and the annular reflective plate 3 stands on the fixing plate 2 and is fixed to the fixing plate 2.

In an embodiment of the present disclosure, the fixing plate 2 may be annular. The edge at the opening of the bowl-shaped structure is fixed to an inner edge of the annular fixing plate 2. The annular reflective plate 3 is fixed to an outer edge of the annular fixing plate 2, and the annular reflective plate 3 is perpendicular to the fixing plate 2.

In the embodiments of the present disclosure, the mounting flat plate 13 and the mounting inclined plate 14 of the antenna substrate 1 may be integrally injection molded, and the antenna substrate 1, the fixing plate 2, and the annular reflective plate 3 may all be integrally injection molded. Furthermore, the antenna substrate 1, the fixing plate 2, and the annular reflective plate 3 may be made of high molecular polymers, for example plastic products such as polyethylene.

The annular reflective plate 3 is used for installation and support of the reflector plate. In the embodiments of the present disclosure, the annular reflective plate 3 may be a plate of a consistent width, or at least one open slot 31 may be provided in the annular reflective plate 3. As illustrated in FIGS. 1, 3, 4 and 6, four open slots 31 are arranged on the annular reflective plate 3, and the position of each open slot 31 corresponds to the interval between two adjacent mounting inclined plates. Further, the four open slots 31 divide the circumference of the annular reflective plate equally, that is, the position of each open slot 31 corresponds to the position of one hollow hole 10 respectively, in such a manner that each mounting inclined plate corresponds to the side wall of a section of annular reflective plate 3. The joint of two adjacent mounting inclined plates is provided with open slots 31, and the depth of the open slots is smaller than the width of the side wall of the annular reflective plate 3. In specific applications, the width of the side wall of the annular reflective plate 3 can be set to different sizes in advance according to antenna requirements.

As illustrated in FIG. 2, the inner surface of the bottom of the bowl-shaped structure is provided with a feed support base 11 for mounting the electrical part of the antenna. As illustrated in FIG. 2, four cable mounting channels 16 are provided in the feed support base 11, and each cable mounting channel 16 corresponds to one threading through hole 15.

In other embodiments of the present disclosure, as illustrated in FIGS. 4, 5 and 6, the antenna mounting base may further include a bottom plate 5.

The bottom plate 5 is fixed to the fixing plate 2 by bolts 51, and the bottom plate 5 and the antenna substrate 1 are respectively located on different sides of the fixing plate 2.

A mounting through hole is arrange on the bottom plate 5 (not illustrated in the figure), and the position of the mounting through hole corresponds to the position of the feed support base.

In comparison with existing product technology, the antenna provided by the embodiments of the present disclosure is simple to assemble, and has stronger structural consistency. The radiating sheet can be directly printed on the outer surface of the antenna substrate, and the feed coaxial cable can be directly attached to the antenna substrate when the radiating sheet and the feed coaxial cable are mounted. In addition, the antenna substrate, the fixing plate and the annular reflective plate in the antenna mounting base can be integrally formed, in such a manner that the supporting thickness of the substrate on the back surface of the radiating sheet is thin when used as an antenna, thereby reducing the dielectric loss of the antenna and improving the low gain at a low elevation angle of the antenna.

In a second aspect, the embodiments of the present disclosure provide an antenna, as illustrated in FIGS. 1-9, including a tuning director 6, a feed network (not labeled in the figure), a reflector plate (not labeled in the figure), and a radiating sheet 9, and the antenna mounting base described in the first aspect.

As illustrated in FIGS. 4, 5 and 7, in the embodiments of the present disclosure, a plurality of fixing columns 12 are provided on the outer surface of the mounting flat plate 13 of the antenna substrate 1, optionally four fixing columns, and the four fixing columns 12 are uniformly distributed on the mounting flat plate. The tuning director 6 is connected to the outer surface of the bottom of the bowl-shaped structure of the antenna substrate 1 through a plurality of fixing columns 12, and an interval is arranged between the tuning director 6 and the antenna substrate 1.

The radiating sheet 9 is fixed on the outer surface of the bowl-shaped structure of the antenna substrate 1; the reflector plate is fixed on the annular reflective plate 3 (both inner and outer surfaces); the feed network is mounted in the feed support base 11, and the feed network is electrically connected to the radiating sheet 9.

As illustrated in FIGS. 8 and 9, the hexagonal pattern filled in the figure is only for the convenience of distinguishing the radiating sheet from the antenna base after the radiating sheet is mounted, that is, the hexagonal pattern is a filling pattern on the radiating sheet, and is not the structure or shape of the radiating sheet 9. The radiating sheets 9 include four plates, each radiating sheet includes a first sub-part 91 and a second sub-part 92. The first sub-parts 91 of the four radiating sheets are all located on the mounting flat plate 13 and are provided with intervals with each other and insulated from each other, and the first sub-parts 91 of the four radiating sheets 9 are equal in area, that is, as illustrated in FIG. 8, the first sub-parts 91 of the four radiating sheets 9 are all triangular.

The first sub-part 91 of each radiating sheet is provided with a wiring through hole 93 and a fixing column through hole 94 for passing through the fixing column. The areas of the second sub-parts of the four radiating sheets 9 are equal and are respectively located on different mounting inclined planes. Further, the second sub-parts are composed of rectangles and triangles, the first side of the rectangle is connected to the long side of the triangle in the first sub-part, and the other side of the rectangle opposite to the first side is connected to the long side of the triangle in the second sub-part.

In the embodiments of the present disclosure, the feed network may adopt a compensation branch conductor balun feed network. As illustrated in FIGS. 2 and 4, the feed network may include two pairs of coaxial cables and a 90° phase shifter 72, the two pairs of coaxial cables are staggered in the feed support base 11, i.e., two cables in the same pair of coaxial cables are not adjacent to each other, also known as two pairs of coaxial cables are orthogonally distributed in the feed support base 11. Furthermore, the 90° phase shifter and the two pairs of coaxial cables are respectively located on different sides of the bottom plate.

Each pair of coaxial cables includes a first coaxial cable 70 and a second coaxial cable 71, the outer conductors of the first coaxial cable 70 and the second coaxial cable 71 are respectively connected to one radiating sheet through the wiring through hole, and the radiating sheets connected to the two pairs of coaxial cables are staggered, that is, the radiating sheets connected to two cables of the same pair of coaxial cables are not adjacent to each other.

In addition, the end of the inner conductor of the first coaxial cable 70 is a broken circuit; the inner conductor of the second coaxial cable 71 is electrically connected to the 90° phase shifter.

In an embodiment of the present disclosure, the tune director is a metal plate, and the shape of the tuning director is circular.

In an embodiment of the present disclosure, the radiating sheet 9 is a printed metal layer arranged on the outer surface of the antenna substrate 1.

In an embodiment of the present disclosure, the reflector plate is a printed metal layer arranged on the outer surface of the annular reflective plate, and the shape of the reflector plate is consistent with the shape of the annular reflective plate, that is, the reflector plate is also annular, and the open slot is also arranged on the reflector plate.

According to the antenna provided by the embodiments of the disclosure, in actual application, the beam width is adjustable, and the product body has strong adaptability; the reflector plate on the annular reflective plate is mainly used for adjusting the beam width and the return loss; in actual application, the current distribution mode can be changed by adjusting the height on the annular reflective plate, i.e. adjusting the width of the reflector plate, such that the adjustment of the beam width and the return loss can be realized, in such a manner that the required beam width and the smaller return loss can be obtained under different use conditions, and further the required low gain at a low elevation angle and beam width can be obtained.

In addition, since the feed network adopts a broadband compensation branch conductor balun feed network, the first coaxial cable 70 and the second coaxial cable 71 of the feed network are a group, and the first coaxial cable 70 and the second coaxial cable 71 are connected as inner conductors, and the outer conductors are respectively connected to the aligned radiating sheet 9, that is, connected to the radiating sheet. The second coaxial cable 71 is a direct feed connection line, with an input impedance of 50Ω, the first coaxial cable 70 is in a broken circuit at the end of the inner conductor, with an impedance of 35Ω, and the length of the first coaxial cable 70 can be adjusted according to the designed frequency band adjustment, so that the current balance of the antenna is good, and the impedance matching bandwidth is adjustable.

It should be noted that the relational terms herein, such as "first" and "second", are used only for differentiating one entity or operation, from another entity or operation, which, however do not necessarily require or imply that there should be any real relationship or sequence. Moreover, the terms "comprise", "include" or any other variations thereof are meant to cover non-exclusive including, so that the process, method, article or device comprising a series of elements do not only comprise those elements, but also comprise other elements that are not explicitly listed or also comprise the inherent elements of the process, method, article or device. In the case that there are no more restrictions, an element qualified by the statement "comprises a . . . " does not exclude the presence of additional identical elements in the process, method, article or device that comprises the said element.

The above description is only the specific embodiments of the present disclosure to enable those skilled in the art to understand or implement the present disclosure. Various modifications to these embodiments will be obvious to those skilled in the art, and the general principles defined herein may be implemented in other embodiments without departing from the spirit or scope of the present disclosure. Therefore, the present disclosure is not to be limited to the embodiments illustrated herein, but is to be accorded the widest scope consistent with the principles and novel features applied herein.

INDUSTRIAL APPLICABILITY

According to the antenna provided by the embodiments of the disclosure, in actual application, the beam width is adjustable, and the product body has strong adaptability; the reflector plate on the annular reflective plate is mainly used for adjusting the beam width and the return loss; in actual application, the current distribution mode can be changed by adjusting the height on the annular reflective plate, i.e. adjusting the width of the reflector plate, such that the adjustment of the beam width and the return loss can be realized, in such a manner that the required beam width and the smaller return loss can be obtained under different use conditions, and further the required low pitch angle gain and beam width can be obtained, thus having strong industrial practicability.

What is claimed is:

1. An antenna mounting base, comprising: an antenna substrate, a fixing plate and an annular reflective plate, wherein, the antenna substrate is of a bowl-shaped structure, and an edge of an opening of the bowl-shaped structure is fixed to the fixing plate; the annular reflective plate stands on the fixing plate and is fixed to the fixing plate; the annular reflective plate and the antenna substrate are located on the same side of the fixing plate; and a feed support base is provided inside the bowl-shaped structure.

2. The antenna mounting base according to claim 1, wherein the antenna substrate comprises a mounting flat plate and four mounting inclined plates, wherein, the four mounting inclined plates are uniformly distributed around the mounting flat plate;

a first side edge of each mounting inclined plate is fixed to an edge of the mounting flat plate; a second side edge of each mounting inclined plate is fixed to the fixing plate, the first side edge and the second side edge being opposite in position; and an included angle is formed between each mounting inclined plate and the mounting flat plate.

3. The antenna mounting base according to claim 2, further comprising four threading through holes uniformly arranged in the mounting flat plate, wherein the feed support base comprises four cable mounting channels, and a position of each cable mounting channel corresponds to a position of one threading through hole.

4. The antenna mounting base according to claim 2, further comprising four open slots arranged in the annular reflective plate;

wherein the four open slots divide a circumference of the annular reflective plate equally, and a center of each open slot corresponds to a center between two mounting inclined plates.

5. The antenna mounting base according to claim 1, wherein the fixing plate is annular;

the edge of the opening of the bowl-shaped structure is fixed to an annular inner edge of the fixing plate; and the annular reflective plate is fixed to an annular outer edge of the fixing plate, and the annular reflective plate is perpendicular to the fixing plate.

6. The antenna mounting base according to claim 1, further comprising a bottom plate, wherein, the bottom plate is fixed to the fixing plate, and the bottom plate and the antenna substrate are respectively located at different sides of the fixing plate; and a mounting through hole is provided in the bottom plate, and a position of the mounting through hole corresponds to a position of the feed support base.

7. An antenna, comprising an antenna mounting base according to claim 1, and further comprising a tuning director, a feed network, a reflector plate and a radiating sheet, wherein, four fixing columns are arranged on an outer surface of the mounting flat plate of the antenna mounting base, and the four fixing columns are uniformly distributed on the mounting flat plate;

the tuning director is connected to an outer surface of a bottom of the bowl-shaped structure of the antenna substrate through a plurality of fixing columns, and an interval is provided between the tuning director and the antenna substrate;

the radiating sheet is fixed to an outer surface of the bowl-shaped structure of the antenna substrate;

the reflector plate is fixed to the annular reflective plate and is provided with at least one open slot; and the feed network is mounted in the feed support base, and the feed network is electrically connected to the radiating sheet.

8. The antenna according to claim 7, wherein four radiating sheets are provided, each radiating sheet comprises a first sub-part and a second sub-part, the first sub-part of the four radiating sheets is all located at the mounting flat plate and provided with an interval between each other, the first sub-part of the four radiating sheets is equal in area and is all triangular;

the first sub-part of each radiating sheet is provided with a wiring through hole and a fixing column through hole for the fixing column to pass through; and an area of the second sub-part of the four radiating sheets is equal and respectively located on different inclined mounting surfaces, the second sub-part comprises rectangles and triangles, a first side edge of the rectangle is connected to a long side of the triangle in the first sub-part, and another side edge of the rectangle opposite to the first side edge is connected to a long side of the triangle of the second sub-part.

9. The antenna according to claim 8, wherein the feed network comprises two pairs of coaxial cables and a 90° phase shifter, wherein, the two pairs of coaxial cables are staggered in the feed support base; the 90° phase shifter and two pairs of coaxial cables are respectively located at different sides of a bottom plate; and each pair of coaxial cables comprises a first coaxial cable and a second coaxial cable, outer conductors of the first coaxial cable and the second coaxial cable are respectively connected to a radiating sheet through the wiring through hole, and the radiating sheets connected to the two pairs of coaxial cables are staggered; an end of an inner conductor of the first coaxial cable is in a broken circuit; an inner conductor of the second coaxial cable is electrically connected to the 90° phase shifter.

10. The antenna according to claim 7, wherein the tuning director is a metal plate, and a shape of the tuning director is circular;

and/or;

the radiating sheet is a printed metal layer arranged on an outer surface of the antenna substrate;

and/or, the reflector plate is a printed metal layer arranged on an outer surface of the annular reflective plate, and a shape of the reflector plate is consistent with a shape of the annular reflective plate.

11. The antenna mounting base according to claim 2, wherein the fixing plate is annular;

the edge of the opening of the bowl-shaped structure is fixed to an annular inner edge of the fixing plate; and the annular reflective plate is fixed to an annular outer edge of the fixing plate, and the annular reflective plate is perpendicular to the fixing plate.

12. The antenna mounting base according to claim 3, wherein the fixing plate is annular;

the edge of the opening of the bowl-shaped structure is fixed to an annular inner edge of the fixing plate; and the annular reflective plate is fixed to an annular outer edge of the fixing plate, and the annular reflective plate is perpendicular to the fixing plate.

13. The antenna mounting base according to claim 4, wherein the fixing plate is annular;

the edge of the opening of the bowl-shaped structure is fixed to an annular inner edge of the fixing plate; and the annular reflective plate is fixed to an annular outer edge of the fixing plate, and the annular reflective plate is perpendicular to the fixing plate.

14. The antenna mounting base according to claim 1, further comprising a bottom plate, wherein, the bottom plate is fixed to the fixing plate, and the bottom plate and the antenna substrate are respectively located at different sides of the fixing plate; and a mounting through hole is provided in the bottom plate, and a position of the mounting through hole corresponds to a position of the feed support base.

15. The antenna mounting base according to claim 2, further comprising a bottom plate, wherein, the bottom plate is fixed to the fixing plate, and the bottom plate and the antenna substrate are respectively located at different sides of the fixing plate; and a mounting through hole is provided in the bottom plate, and a position of the mounting through hole corresponds to a position of the feed support base.

16. The antenna mounting base according to claim 3, further comprising a bottom plate, wherein, the bottom plate is fixed to the fixing plate, and the bottom plate and the antenna substrate are respectively located at different sides of the fixing plate; and a mounting through hole is provided in the bottom plate, and a position of the mounting through hole corresponds to a position of the feed support base.

17. The antenna mounting base according to claim 4, further comprising a bottom plate, wherein, the bottom plate is fixed to the fixing plate, and the bottom plate and the antenna substrate are respectively located at different sides of the fixing plate; and a mounting through hole is provided in the bottom plate, and a position of the mounting through hole corresponds to a position of the feed support base.

18. The antenna mounting base according to claim 5, further comprising a bottom plate, wherein, the bottom plate is fixed to the fixing plate, and the bottom plate and the antenna substrate are respectively located at different sides of the fixing plate; and a mounting through hole is provided in the bottom plate, and a position of the mounting through hole corresponds to a position of the feed support base.

19. The antenna according to claim 8, wherein the tuning director is a metal plate, and a shape of the tuning director is circular;

and/or;

the radiating sheet is a printed metal layer arranged on an outer surface of the antenna substrate;

and/or, the reflector plate is a printed metal layer arranged on an outer surface of the annular reflective plate, and a shape of the reflector plate is consistent with a shape of the annular reflective plate.

20. The antenna according to claim 9, wherein the tuning director is a metal plate, and a shape of the tuning director is circular;

and/or;

the radiating sheet is a printed metal layer arranged on an outer surface of the antenna substrate;

and/or, the reflector plate is a printed metal layer arranged on an outer surface of the annular reflective plate, and a shape of the reflector plate is consistent with a shape of the annular reflective plate.

* * * * *